US007069908B2

(12) United States Patent
Ohkubo et al.

(10) Patent No.: US 7,069,908 B2
(45) Date of Patent: Jul. 4, 2006

(54) FUEL INJECTOR FOR IN-CYLINDER INJECTION

(75) Inventors: Kenji Ohkubo, Toyota (JP); Masaaki Yano, Aichi-ken (JP); Yukiharu Tomita, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/946,185

(22) Filed: Sep. 22, 2004

(65) Prior Publication Data

US 2005/0066942 A1 Mar. 31, 2005

(30) Foreign Application Priority Data

Sep. 25, 2003 (JP) ..... 2003-334098

(51) Int. Cl.
*F02M 61/14* (2006.01)

(52) U.S. Cl. ..... 123/470; 277/313

(58) Field of Classification Search ..... 123/470; 277/313

See application file for complete search history.

(56) References Cited

U.S. PATENT DOCUMENTS 4,528,959 A * 7/1985 Hauser, Jr. ..... 123/470
5,121,731 A * 6/1992 Jones ..... 123/470
5,247,918 A * 9/1993 Wakeman ..... 123/470
5,694,898 A * 12/1997 Pontoppidan et al. ..... 123/470
6,186,123 B1 * 2/2001 Maier et al. ..... 123/470
6,561,167 B1 * 5/2003 Berndt ..... 123/531
6,892,707 B1 * 5/2005 Reiter et al. ..... 123/470

FOREIGN PATENT DOCUMENTS

JP 11-294302 10/1999
JP 2000-009000 1/2000

* cited by examiner

*Primary Examiner*—Thomas Moulis
(74) *Attorney, Agent, or Firm*—Kenyon & Kenyon LLP

(57) ABSTRACT

An injector for directly injecting fuel into a cylinder of an internal combustion engine having a socket. The injector is provided with a nozzle insertable into the socket. An annular gap is defined between the nozzle and the socket when the nozzle is received in the socket. A first seal groove, formed in the nozzle, receives a first gas seal that seals the annular gap. A second seal groove, formed in the nozzle, receives a second gas seal that seals the annular gap. The second seal groove is formed closer to the distal end of the nozzle than the first seal groove. The depth of the second seal groove is greater than that of the first seal groove. This structure prevents the formation of deposits and maintains the sealing capability of the gas seals without lowering installation and maintenance efficiency.

15 Claims, 2 Drawing Sheets

FUEL INJECTOR FOR IN-CYLINDER INJECTION

CROSS-REFERENCE TO RELATED APPLICATIONS

This application is based upon and claims priority from Japanese Patent Application No. 2003-334098 filed on Sep. 25, 2003, which is herein incorporated in its entirety by reference.

BACKGROUND OF THE INVENTION

The present invention relates to an injector for injecting fuel into a cylinder of an in-cylinder injection type internal combustion engine.

FIG. 3 shows a structure for installing a conventional in-cylinder injector, which is described in Japanese Laid-Open Patent Publication No. 2000-9000. An in-cylinder injector 100 is installed in a socket 111, which is formed in a cylinder head 110 of an internal combustion engine. The socket 111 has a stepped portion, shaped in correspondence with the distal portion of the injector 100. To install the injector 100, a nozzle 101 of the injector 100 is inserted into a linear portion 112 of the socket 111, and a large diameter portion 102 of the injector 100 is loosely fitted in an outer opening 113 of the socket 111.

The upper end of the injector 100 is inserted in a delivery pipe 120. The injector 100 is fastened to the delivery pipe 120 by a screw 121. An arm 122 extending from the delivery pipe 120 is fastened to the cylinder head 110 via an insulator 123. In this way, the delivery pipe 120 and the injector 100 are fixed to the cylinder head 110.

An annular groove 103 extends along the outer surface of the nozzle 101 at the axial middle portion of the injector 100. An annular seal 104 is tightly fit in the annular groove 103. The annular seal 104 is elastically deformed when the nozzle 101 is inserted into the linear portion 112 of the socket 111. The annular seal 104 enables the injector 100 to be held in the socket 111 in a non-contact manner (i.e., in a floating state) while preventing leakage of combustion gas from the internal combustion engine. The annular seal 104 is usually made from a fluorocarbon resin, such as polytetrafluoroethylene (PTFE), or an elastic resin with high heat resistance, such as fluorocarbon rubber.

Due to the structure of the in-cylinder injector, the annular seal 104, which is a gas seal, is directly affected by the high temperature and high pressure of the combustion gas. This may deteriorate or melt the gas seal, even though the gas seal is made from a resin with high heat resistance. To prevent such deterioration and melting of the gas seal, the gas seal is separated from the distal end of the injector nozzle by a certain distance.

However, the distance between the gas seal and the nozzle end may result in a tendency for high-temperature combustion gas flowing to the distal portion of the nozzle 101. This would increase the temperature at the distal portion and form deposits on the distal portion. To solve this problem, another gas seal may be arranged on the distal portion of the nozzle to prevent high-temperature combustion gas from flowing to the distal portion. However, a plurality of gas seals attached to the nozzle would increase the load required to insert the injector in the socket and lower efficiency when installing the injector or performing maintenance work on the injector.

SUMMARY OF THE INVENTION

It is an object of the present invention to provide an injector for in-cylinder injection that prevents the formation of deposits while maintaining high sealing capability of a gas seal without lowering installation and maintenance efficiency.

One aspect of the present invention is an injector for directly injecting fuel into a cylinder of an internal combustion engine having a socket. The injector includes a nozzle insertable into the socket. The nozzle includes a distal end. An annular gap is defined between the nozzle and the socket when the nozzle is received in the socket. A first seal groove is formed in the nozzle to receive a first gas seal that seals the annular gap. The first seal groove having a first depth. A second seal groove is formed in the nozzle to receive a second gas seal that seals the annular gap. The second seal groove is formed closer to the distal end of the nozzle than the first seal groove and has a second depth that is greater than the first depth.

Another aspect of the present invention is an injector for directly injecting fuel into a cylinder of an internal combustion engine having a socket. The injector includes a nozzle insertable into the socket. The nozzle includes a distal end. An annular gap is defined between the nozzle and the socket when the nozzle is received in the socket. A first seal groove is formed in the nozzle to receive a first gas seal that seals the annular gap. The first seal groove has a first cross-sectional shape. A second seal groove is formed in the nozzle to receive a second gas seal that seals the annular gap. The second seal groove is formed closer to the distal end of the nozzle than the first seal groove and has a second cross-section. The first and second cross sections are determined so that deformation amount of the first gas seal is greater than deformation amount of the second gas seal when the nozzle is received in the socket.

A further aspect of the present invention is an injector for directly injecting fuel into a cylinder of an internal combustion engine having a socket. The injector includes a nozzle insertable into the socket. The nozzle includes a distal end. An annular gap is defined between the nozzle and the socket when the nozzle is received in the socket. The injector further includes first and second gas seals, and means for mounting the first and second gas seals around the nozzle with one seal closer to the nozzle distal end than the other, and for providing that the other seal has a deformation amount greater than that of the one seal when the nozzle is received in the socket.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
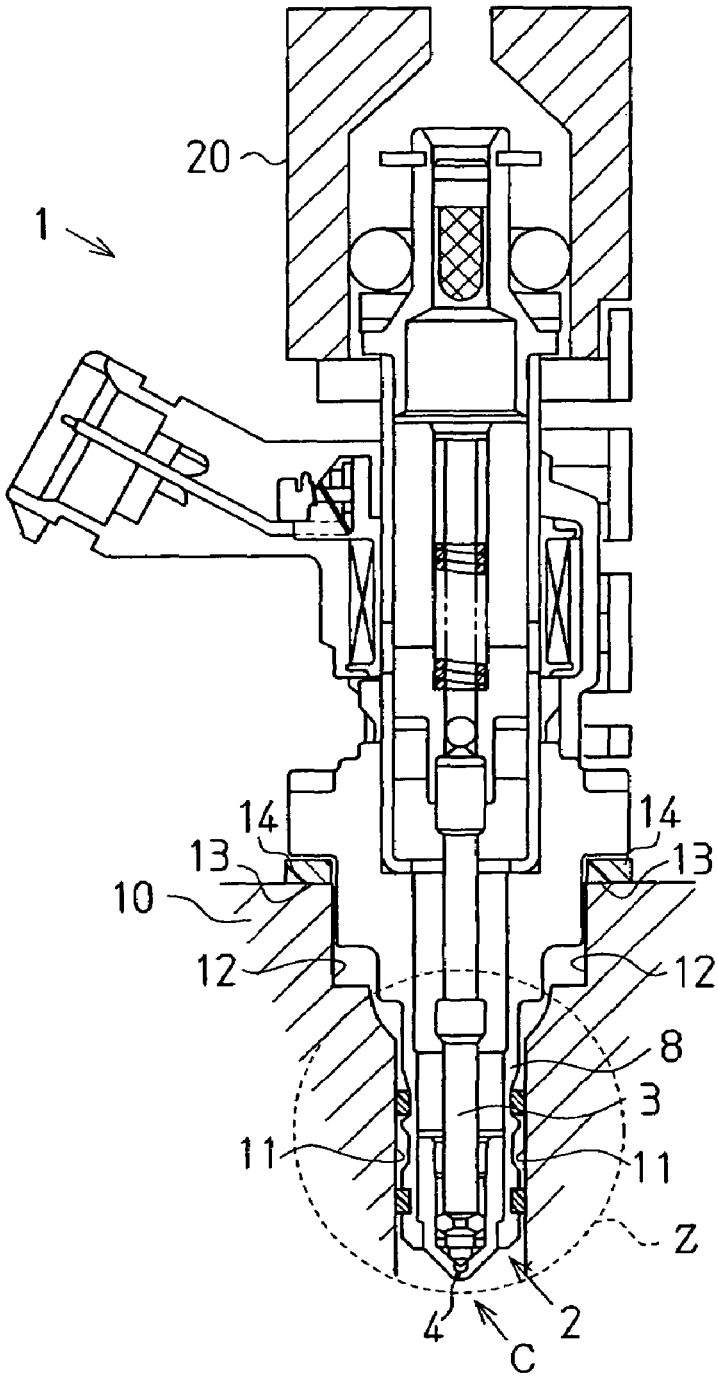
FIG. 1 is a schematic cross section of an in-cylinder injector according to a preferred embodiment of the present invention.

An in-cylinder injector according to a preferred embodiment of the present invention will now be described with reference to FIG. 1. The in-cylinder injector is applied to an in-cylinder type gasoline engine.

An internal combustion engine (gasoline engine) is mainly composed of a cylinder block (not shown) and a cylinder head 10. The cylinder head 10 has, near its intake port (not shown), a socket 11 (i.e., a columnar cavity), which extends into a combustion chamber C, and an outer opening 12. The outer opening 12 includes an injector seat 13. A secondary seal 14 is arranged on the injector seat 13. A fuel injector 1 is installed in the socket 11 and the outer opening 12. In more detail, the injector 1 is installed in the cylinder head 10 by inserting a nozzle 8 of the injector 1 into the socket 11 so that the injector 1 partially comes into contact with the secondary seal 14.

The injector 1 has an end opposite to the nozzle 8. This end is coupled to a delivery pipe 20, through which high-pressure fuel is delivered from a fuel supply system.

The nozzle 8 includes a distal portion 2, which includes the distal end of the injector 1 facing towards the combustion chamber C. An injection hole 4 for injecting fuel into the combustion chamber C is formed in the distal portion 2. The injection hole 4 is opened and closed by electromagnetically driving a needle valve 3, which controls the starting and stopping of fuel injection.

The injector 1 is installed in the cylinder head 10 so that the distal portion 2 is exposed to the combustion chamber C of the engine. Fuel is directly injected into the combustion chamber C from the distal portion 2 by opening the needle valve 3 when high-pressure fuel is supplied from the delivery pipe 20. The direct injection of fuel causes a combustible mixture to be locally formed in the combustion chamber C. A spark plug (not shown) attached to the cylinder head 10 ignites and burns the combustible mixture.

Figure 2:
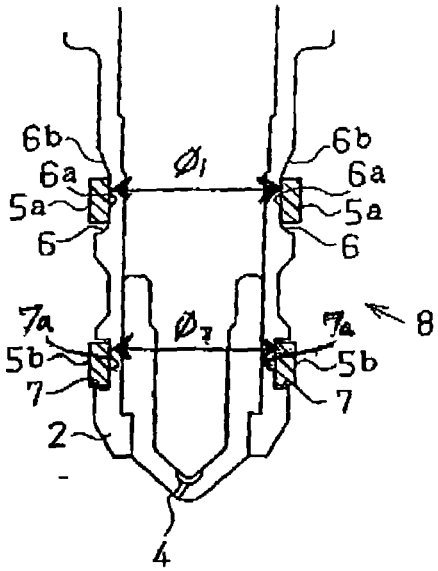
FIG. 2 is a partially enlarged cross section of the injector of FIG. 1.
Figure 3:
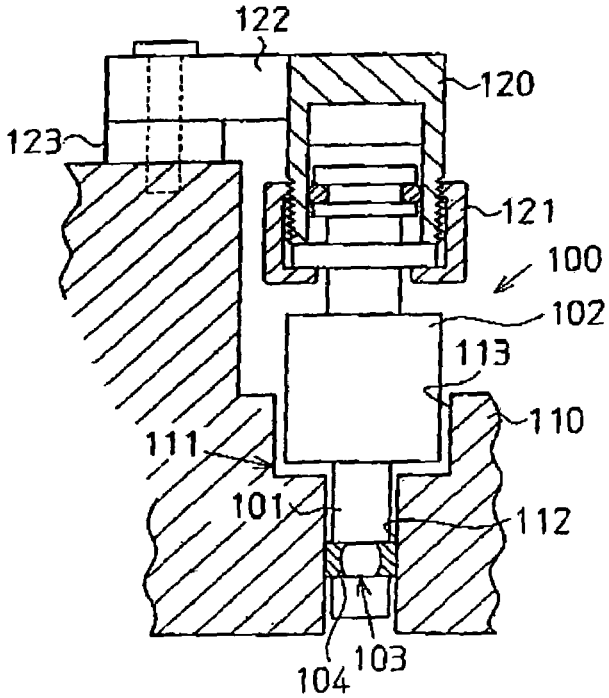
Fig.3 (Prior Art)
FIG. 3 is a schematic cross section of a conventional in-cylinder injector.

FIG. 2 is an enlarged view of area Z encircled by a broken line in FIG. 1 and shows the nozzle 8 of the injector 1.

As shown in FIG. 2, a first seal groove 6 and a second seal groove 7 are formed in the nozzle 8 of the injector 1. First and second gas seals 5*a* and 5*b* are arranged in the first and second seal grooves 6 and 7, respectively. The first and second gas seals 5*a* and 5*b* seal an annular gap defined between the nozzle 8 and the socket 11 (FIG. 1). The first seal groove 6 is formed at a position separated by a certain distance from the distal end of the nozzle 8 (the end closer to the combustion chamber). The first seal groove 6 includes a bottom wall 6*a* and a sloped wall 6*b*. The sloped wall 6*b* extends from the bottom wall 6*a* toward the basal end of the injector 1 in a manner that the space between the sloped wall 6*b* and the wall of the socket 11 narrows as the basal end of the injector 1 becomes closer. The second seal groove 7 is formed at a position closer to the distal end of the nozzle 8 than the first seal groove 6. The second seal groove 7 has a rectangular cross section and includes a bottom wall 7*a*. It is preferable that the second seal groove 7 be deeper than the first seal groove 6. Thus, a distance $\phi_1$ between bottom walls 6*a* may be greater than a distance $\phi_2$ between bottom walls 7*a*.

The first and second gas seals 5*a* and 5*b* have the same shape and are made from the same material. Each of the first and second gas seals 5*a* and 5*b* is annular and has a rectangular cross section. Preferable materials for the gas seals 5*a* and 5*b* are resins having excellent heat resistance, such as polytetrafluoroethylene (PTFE), a resin composition composed of PTFE and filler, and an elastomer.

With the first and second gas seals 5*a* and 5*b* respectively arranged in the first and second seal grooves 6 and 7, the injector 1 functions as follows.

Normally, the nozzle of an in-cylinder injector is exposed to a combustion chamber C of an engine. Thus, the in-cylinder injector must have high sealing capability to securely seal and prevent leakage of high-pressure combustion gas, which is generated in the combustion chamber C. In the injector 1 of the present invention, the first gas seal 5*a* arranged in the first seal groove 6 prevents leakage of fuel gas and combustion gas.

Further, the second gas seal 5*b* arranged in the second seal groove 7 prevents high-temperature combustion gas from flowing to the distal portion 2. This prevents the temperature at the distal portion 2 from increasing and minimizes the formation of deposits on the distal portion 2. The first gas seal 5*a* arranged in the first seal groove 6 functions to seal in combustion gas. Thus, the second gas seal 5*b* only has to prevent combustion gas from flowing to the distal portion 2. Further, the sealing capability for sealing in combustion gas remains intact even if the second gas seal 5*b* arranged in the second seal groove 7 deteriorates or melts.

The second seal groove 7 is deeper than the first seal groove 6. When the gas seals 5*a* and 5*b* are identical to each other, the squeezed amount (i.e., deformation amount or compression amount) of the second gas seal 5*b* arranged in the second seal groove 7 is smaller than the squeezed amount of the first gas seal 5*a* when the injector 1 is received in the socket 11. This structure prevents the load produced when inserting the injector 1 into the socket 11 from increasing. Thus, installation and maintenance efficiency of the injector 1 are not affected.

In addition to being deeper than the first seal groove 6, the cross section of the second seal groove 7 is rectangular. This structure prevents the surface pressure (resistance) produced when the second gas seal 5*b* is deformed from increasing. The load produced when inserting the injector 1 into the socket 11 is prevented from being increased.

To improve the sealing capability, the first seal groove 6 includes the sloped wall 6*b*, which extends from the bottom wall 6*a* so that the space between the sloped wall 6*b* and the wall of the socket 11 narrows as the basal end of the injector 1 becomes closer. When receiving the pressure of combustion gas, the first gas seal 5*a* moves along the sloped wall 6*b*. This movement causes the first gas seal 5*a* to press the surface of the socket 11 with a higher surface pressure and ensures the sealing of the annular gap between the nozzle 8 and the socket 11.

Further, the injector 1 is supported on the cylinder head 10 by the secondary seal 14, which is arranged on the injector seat 13 of the outer opening 12. The secondary seal 14, which is made from a resin having high heat resistance, also has a sealing effect. This improves the capability for preventing combustion gas leakage and diffusing heat.

The in-cylinder injector of the preferred embodiment has the advantages described below.

(1) The first gas seal 5*a*, which is arranged in the first seal groove 6 to seal the annular gap between the nozzle 8 and the socket 11, prevents the leakage of combustion gas.

(2) The second gas seal 5*b*, which is arranged in the second seal groove 7, prevents high-temperature combustion gas from flowing to the distal portion 2. This structure prevents the temperature at the distal portion 2 from increasing and prevents deposits from forming on the distal portion 2.

(3) The first and second gas seals 5*a* and 5*b* have the same shape and are made from the same material. Thus, different types of gas seals do not need to be prepared. This reduces the manufacturing cost and eliminates the need to distinguish and select the appropriate type of gas seal.

(4) The second seal groove 7 is deeper than the first seal groove 6. Thus, even through the first and second gas seals 5*a* and 5*b* are identical to each other, the squeezed amount of the second gas seal 5*b* arranged in the second seal groove 7 is smaller than that of the first gas seal 5*a* when the injector 1 is installed. This structure prevents the load produced when installing the injector 1 from increasing. Thus, installation and maintenance efficiency of the injector 1 are not affected.

(5) The second seal groove 7 has a rectangular cross section. This prevents an increase in the surface pressure produced when the second gas seal 5*b* arranged in the second seal groove 7 is deformed during the insertion of the injector 1 into the socket 11. As a result, the load produced when installing the injector 1 is prevented from being increased.

(6) The first seal groove 6 includes the sloped wall 6*b*, which extends from the bottom wall 6*a* in a manner that the space between the sloped wall 6*b* and the wall of the socket 11 narrows as the basal end of the injector 1 becomes closer. When receiving the pressure of combustion gas, the first gas seal 5*a* arranged in the first seal groove 6 moves along the sloped wall 6*b*. The movement causes the first gas seal 5*a* to press the wall of the socket 11 with a higher surface pressure. This efficiently prevents the leakage of gas from the annular gap between the nozzle 8 and the socket 11 and improves the sealing capability.

It should be apparent to those skilled in the art that the present invention may be embodied in many other specific forms without departing from the spirit or scope of the invention. Particularly, it should be understood that the present invention may be embodied in the following forms.

In the preferred embodiment, a resign material having high heat resistance, more specifically, polytetrafluoroethylene (PTFE), a resin compound composed of PTFE and filler, or an elastic resin material such as elastomer, is used for the first and second gas seals Sa and 5*b*. However, the material for the gas seals 5*a* and 5*b* are not limited to such resin materials. Fluorocarbon resins are often used as such resin materials that have a high heat resistance, and PTFE is one example of a fluorocarbon resin. Other fluorocarbon resins such as perfluoroalkoxy (PFA), ethylene tertafluoroethylene (ETFE), fluorinated ethylene propylene (FEP), polyvinylidene fluoride (PVDF), and ethylene chlorotrifluoroethylene (ECTFE) may also be used. Further, a resin sealing material having high heat resistance is used for the secondary seal 14. Like the gas seals, the resin materials listed above may also be used for the secondary seal 14.

In the preferred embodiment, the first and second gas seals 5*a* and 5*b* have the same shape and are made from the same material. However, the first and second gas seals 5*a* and 5*b* may be shaped differently from each other or may be made from different materials as long as the first and second seal grooves 6 and 7 are formed so that the squeezed amount of the first gas seal 5*a* is greater than the squeezed amount of the second gas seal 5*b*. In this case, the same advantages as the preferred embodiment are obtained.

It is preferable that the first seal groove 6 includes the sloped wall 6*b* to obtain a satisfactory sealing capability. However, the first seal groove 6 may be a rectangular groove.

The present invention is not limited to an injector for a gasoline direct injection engine and may also be applied to an injector for a diesel engine.

The present examples and embodiments are to be considered as illustrative and not restrictive, and the invention is not to be limited to the details given herein, but may be modified within the scope and equivalence of the appended claims.

What is claimed is:

1. An injector for directly injecting fuel into a cylinder of an internal combustion engine having a socket, the injector comprising:

a nozzle insertable into the socket, the nozzle including a distal end, wherein an annular gap is defined between the nozzle and the socket when the nozzle is received in the socket;

a first seal groove, formed in the nozzle, for receiving a first gas seal that seals the annular gap, the first seal groove having a first depth;

a second seal groove, formed in the nozzle, for receiving a second gas seal that seals the annular gap, the second seal groove being formed closer to the distal end of the nozzle than the first seal groove and having a second depth that is greater than the first depth; and a basal end, wherein the first seal groove includes a sloped wall that forms a space between the sloped wall and the socket when the nozzle is received in the socket, and in which the space narrows in a direction towards the basal end of the injector.

2. The injector according to claim 1, wherein the second seal groove has a rectangular cross section.

3. The injector according to claim 1, further comprising a first gas seal disposed in the first seal groove and a second gas seal disposed in the second seal groove, wherein the first and second gas seals have the same shape and are made from the same material.

4. An injector for directly injecting fuel into a cylinder of an internal combustion engine having a socket, the injector comprising:

a nozzle insertable into the socket, the nozzle including a distal end, wherein an annular gap is defined between the nozzle and the socket when the nozzle is received in the socket;

a first seal groove, formed in the nozzle, for receiving a first gas seal that seals the annular gap, the first seal groove having a first cross-sectional shape; and a second seal groove, formed in the nozzle, for receiving a second gas seal that seals the annular gap, the second seal groove being formed closer to the distal end of the nozzle than the first seal groove and having a second cross-section, wherein the first and second cross sections are determined so that deformation amount of the first gas seal is greater than deformation amount of the second gas seal when the nozzle is received in the socket;

wherein the first seal groove has at least one sloped wall.

5. The injector according to claim 4, wherein the first and second seal grooves each include a depth, and the depth of the first seal groove is less than that of the second seal groove.

6. The injector according to claim 4, wherein the second seal groove includes opposing side walls and a bottom in which both side walls are orthogonal to the bottom.

7. The injector according to claim 4, further comprising a first gas seal disposed in the first seal groove and a second gas seal disposed in the second seal groove, wherein the first and second gas seals are each formed of the same material and have the same shape as one another.

8. The injector according to claim 7, wherein the first and second seals are interchangeable with one another.

9. An injector for directly injecting fuel into a cylinder of an internal combustion engine having a socket, the injector comprising:

a nozzle insertable into the socket, the nozzle including a distal end, wherein an annular gap is defined between the nozzle and the socket when the nozzle is received in the socket;

first and second gas seals; and means for mounting the first and second gas seals around the nozzle with one seal closer to the nozzle distal end than the other, and for providing that said other seal has a deformation amount greater than that of said one seal when the nozzle is received in the socket;

wherein each of the grooves includes a pair of walls and a bottom, with at least one wall of one of the grooves being sloped, and the walls of the other groove being orthogonal to the bottom of that groove.

10. The injector according to claim 9, wherein the means for mounting includes a pair of grooves formed around the nozzle.

11. The injector according to claim 9, wherein the other wall of said one of the grooves is curved.

12. The injector according to claim 9, wherein said other groove receives said other seal.

13. The injector according to claim 9, wherein the first and second seals are substantially identical to one another.

14. The injector according to claim 9, wherein the first and second seals are interchangeable with one another.

15. The injector according to claim 9, wherein the means for mounting includes a pair of grooves formed around the nozzle, with both grooves having a depth in which the depth of one groove is greater than that of the other groove.

* * * * *

UNITED STATES PATENT AND TRADEMARK OFFICE

CERTIFICATE OF CORRECTION

PATENT NO. : 7,069,908 B2
APPLICATION NO. : 10/946185
DATED : July 4, 2006
INVENTOR(S) : Kenji Ohkubo et al.

It is certified that error appears in the above-identified patent and that said Letters Patent is hereby corrected as shown below:

| Column | Line | |
|---|---|---|
| 5 | 43 | Change "seals **S**a" to --seals **5***a*--. |

Signed and Sealed this

Sixth Day of November, 2007

JON W. DUDAS
*Director of the United States Patent and Trademark Office*